US005882067A

United States Patent [19]

Carbajal et al.

[11] Patent Number: 5,882,067

[45] Date of Patent: Mar. 16, 1999

[54] RIGID SEAT FOR FOLDING INVALID WALKER

[75] Inventors: Francisco J. Carbajal, Atwater Village; Eric Carr, Sherman Oaks, both of Calif.

[73] Assignee: Sunrise Medical HHG Inc., Longmont, Colo.

[21] Appl. No.: 871,611

[22] Filed: Jun. 9, 1997

[51] Int. Cl.[6] ..... A61H 3/00

[52] U.S. Cl. ..... 297/6; 299/5; 299/440.24; 299/452.2; 299/344.18; 135/67; 135/74

[58] Field of Search ..... 297/6, 5, 440.22, 297/440.24, 452.2, 338, 344.18; 135/66, 67, 74

[56] References Cited

U.S. PATENT DOCUMENTS

| | | | |
|---|---|---|---|
| 1,448,783 | 3/1923 | Blewitt et al. | 297/6 |
| 2,374,182 | 4/1945 | Duke | 297/6 |
| 2,798,533 | 7/1957 | Frank | 297/6 |
| 3,232,251 | 2/1966 | Hughes | 297/6 |
| 3,249,368 | 5/1966 | Ginzburg | 297/6 |
| 3,442,276 | 5/1969 | Edwards | 135/67 |
| 3,690,652 | 9/1972 | Schneider | 135/67 X |
| 3,993,088 | 11/1976 | Thomas | 135/67 |
| 3,993,349 | 11/1976 | Neufeld et al. | 297/6 |
| 4,046,374 | 9/1977 | Breyley | 297/6 X |
| 4,162,101 | 7/1979 | McCague, Sr. et al. | 297/6 |
| 4,253,678 | 3/1981 | LeClerc | 297/6 X |
| 4,640,301 | 2/1987 | Battiston, Sr. et al. | 135/67 |
| 4,941,708 | 7/1990 | Heffner | 297/6 |
| 5,201,333 | 4/1993 | Shalmon et al. | 135/67 |
| 5,273,063 | 12/1993 | Farr et al. | 135/66 |
| 5,392,802 | 2/1995 | Farr et al. | 135/66 |
| 5,433,235 | 7/1995 | Miric et al. | 135/67 |
| 5,642,748 | 7/1997 | Obitts | 297/6 X |

*Primary Examiner*—Peter M. Cuomo
*Assistant Examiner*—Rodney B. White
*Attorney, Agent, or Firm*—MacMillan, Sobanski & Todd, LLC

[57] ABSTRACT

A foldable seat for a foldable invalid walker where the seat folds flush against the side of the walker when the user is not using the seat.

18 Claims, 4 Drawing Sheets

RIGID SEAT FOR FOLDING INVALID WALKER

BACKGROUND OF THE INVENTION

This invention relates to a seat for use on an invalid walker where the seat folds so that when the seat is not being used, the seat remains on the walker, but does not interfere with the normal use of the walker.

Manufacturers of invalid walkers have developed various types of seating arrangements whereby when the walker is not being used as a walker, it can be used by the patient as a seat. For example, elderly patients sometimes can walk only short distances with the aid of a walker. When the patients tire, often there is no chair available, so having some time of seating capability on the walker itself can be of great benefit to allow the patient to shop, walk around the neighborhood or institution, or generally have improved mobility and quality of life.

The problem with some seating adapted for use on invalid walkers is that they are removable or have to be removed between uses forcing the patient to carry the seat separately. Alternatively, some seats do not allow the walker to fold flat so they are ill-adapted for use with folding type walkers. In addition, some walker seating arrangements make normal use of the walker difficult since some of them require support structures that interfere with the use of a walker when the walker is not being used as a seat. Finally, some seats for use on walkers are not rigid, which allows the user to sink into a flexible style seat perhaps lower than the user should be and still allow the user easy egress from the seated position.

SUMMARY OF THE INVENTION

This invention overcomes many of the foregoing problems. Specifically, this invention is a folding seat for an invalid walker having a pair of sideframes each of which has a horizontal support member. The seat includes a first hanger member adapted to be hung from one of the walker horizontal support members. The first hanger member having an upper member to be secured to the horizontal support and a lower horizontal member to support one end of the rigid seat below the one walker horizontal support member. The seat further includes a substantially rigid seat having a slot at one end that captively receives the lower horizontal support member of the first hanger member but which slot allows the seat to be moved a preselected distance orthogonal to the horizontal support. The folding seat further includes a second hanger member adapted to be hung from the other walker horizontal support member, the second hanger member having an upper member to be secured to the other walker horizontal support and a lower horizontal member to support the other end of the rigid seat below the other walker support member. The other end of the rigid seat has an open recess on its underside that can releasably receive and rest upon the lower horizontal support member of the second hanger member. In this fashion, the rigid seat can be suspended from the two walker horizontal support members, and the seat can be lowered to a fully retracted position by raising the other end of the seat, so that as the open recess disengages from the second hanger member, the seat can be slid toward the first hanger member the preselected distance and lowered to its retracted position where the other end of the seat (i.e., the one with the open recess) clears the inward side of the second hanger member.

Further details of this invention will be apparent from the brief description of the drawings and detailed description provided below.

DETAILED DESCRIPTION OF THE PREFERRED EMBODIMENT

Figure 1:
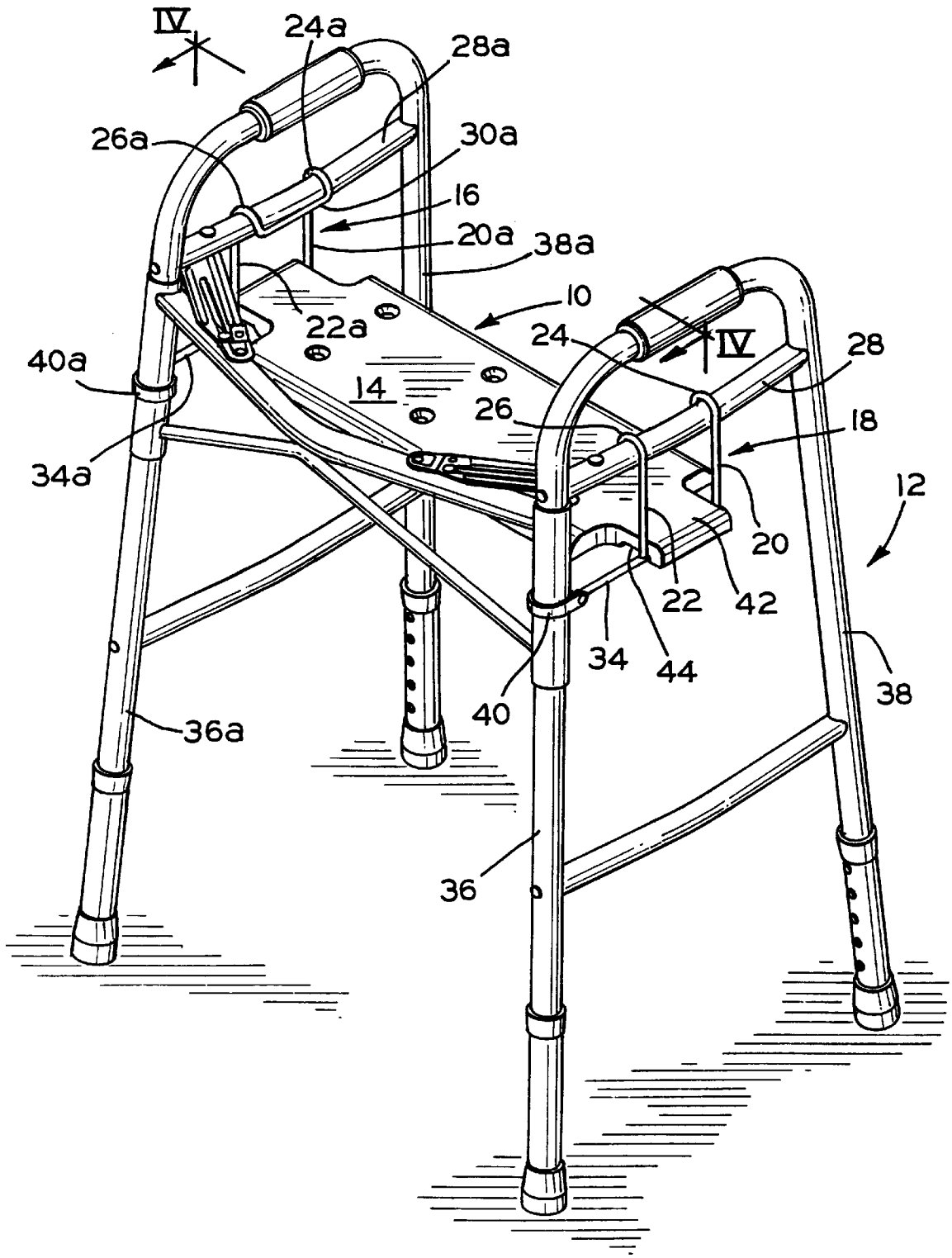
FIG. 1 is perspective view of an invalid walker with the rigid seat of the present invention in the raised position.
Figure 2:
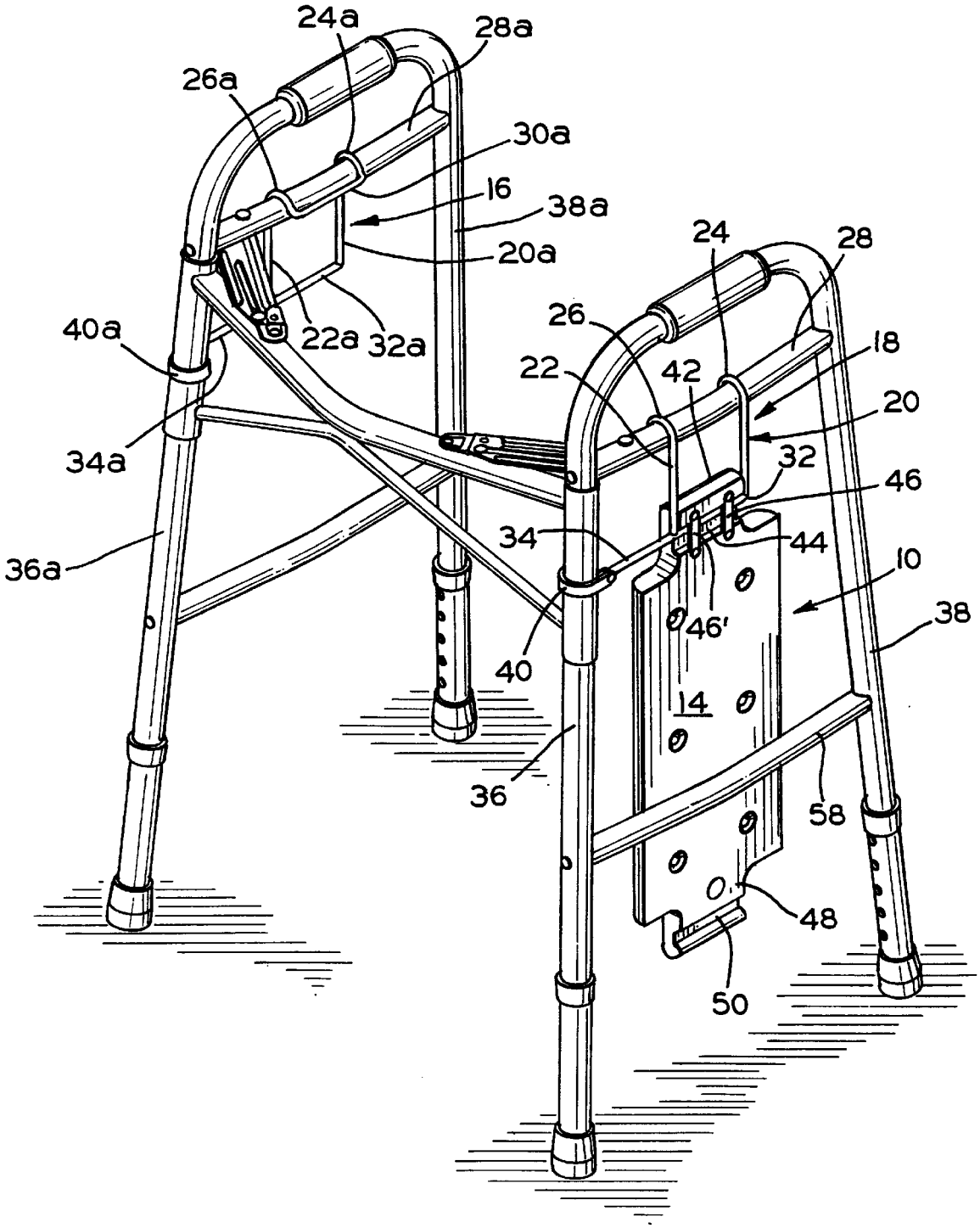
FIG. 2 is a perspective view of an invalid walker with the rigid seat of the present invention in the lowered position.

The rigid seat assembly 10 of this invention is illustrated in the raised position in FIG. 1 and the lowered position in FIG. 2 on a commercially available folding walker 12 the details of which are well-known in the art. The particular walker shown is a Model Number 7755 walker from Guardian Products (a division of Sunrise Medical) also known as the "Red Dot" Walker in the trade. However, the rigid seat of this invention can be used on many other types of folding (and even non-folding) walkers.

Seat assembly 10 includes a substantially rigid seat 14 that extends between a first hanger member 16 and a second hanger member 18. The first and second hanger members are mirror images of one another. Accordingly, hanger member 18 will be described, and hanger member 16 will bear corresponding reference numerals followed by the suffix "a."

Hanger member 18 includes two vertical members 20 and 22, each of which has a hook 24, 26 that when installed hangs on a horizontal support member 28 (or 28*a*) of the invalid walker. The two hooks 24, 26 are joined by a cross-piece 30 (see FIGS. 2 and 3). Preferably, the hooks 24, 26 as well as cross-piece 30 forms a structure which fits interferingly on walker horizontal support member 28.

Hanger member 16 further includes a lower horizontal member 32 that extends between and spaces vertical members 20 and 22 and supports rigid seat 14 in a manner described below. Lower horizontal member 32 also includes forward projecting portion 34 that is secured to one of the front legs 36 of walker 12. The forward projecting portion 34 spaces hanger member 18 from the front of the walker so that the seat can be centered between the front legs 36, 36*a* and the rear legs 38, 38*a* of walker 12. The forward projecting portion 34 is secured by a ring clamp 40 to front leg 36.

Figure 4:
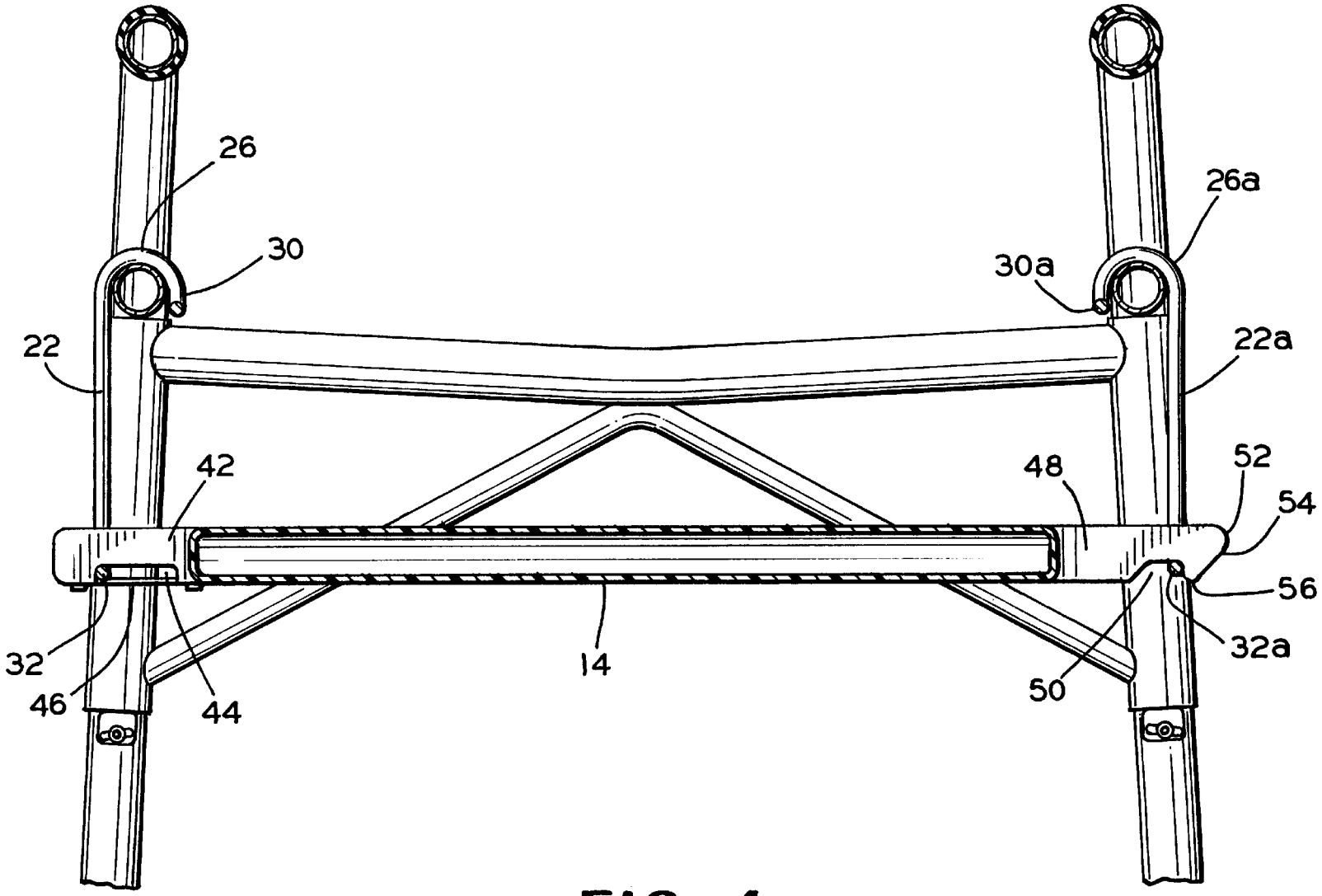
FIG. 4 is a cross-section taken along the plane of line IV—IV of FIG. 1.

A narrowed end portion 42 of rigid seat 14 is positioned between vertical members 20 and 22. At the bottom surface of end portion 42 is a recess 44 that captively receives lower horizontal member 32 by means of two metal retaining strips 46, 46' (see FIGS. 2 and 4) that extend across the recess and are secured in place on either side of the recess by screws. As can be seen in FIG. 4, recess 44 allows seat 14 to be moved orthogonal to lower horizontal member 32 a predetermined distance, namely, the width of recess 44.

The other end of seat member 14 has a narrowed end portion 48 that has an open recess 50 (see FIGS. 2 and 4) on its lower side. Recess 50 receives lower horizontal member 32*a* when seat 14 is in its raised position as shown in FIGS. 1 and 4. To lower seat 14 to its lowered position shown in FIG. 2, end portion 48 is raised from the position shown in FIG. 4 so that lower horizontal member 32*a* is no longer within recess 50. While in that raised position, seat 14 is moved to the left as shown in FIG. 4 such that end portion

Figure 3:
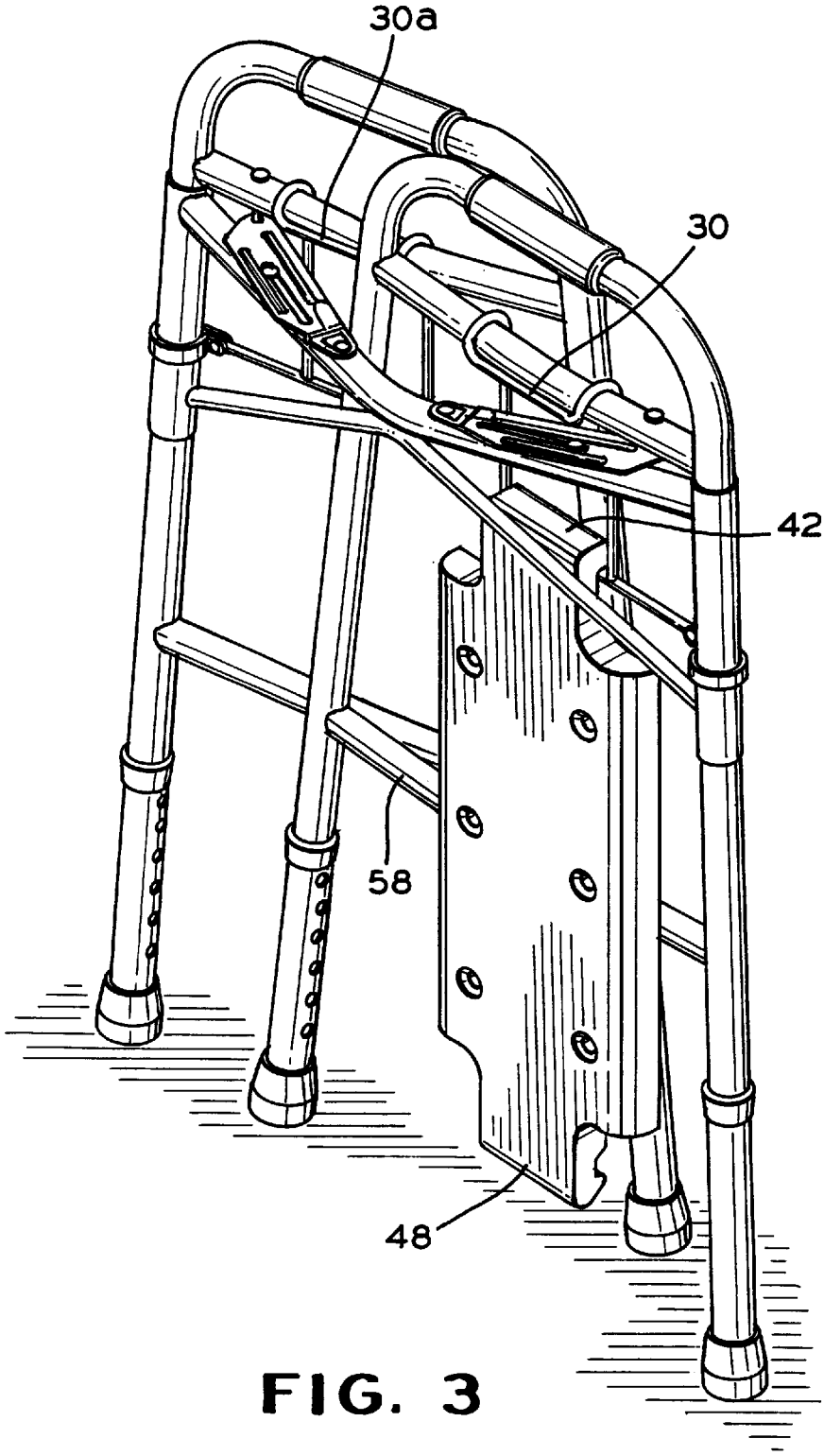
FIG. 3 is a perspective view of an invalid walker in the folded position with the rigid seat of the present invention in the lowered position.

42 slides along lower horizontal member 32 within recess 44 the predetermined distance which will allow the distal end 52 of seat 14 to clear lower horizontal member 32*a* and the seat lowered below horizontal member 32*a* ultimately to its retracted position shown in FIGS. 2 and 3.

To raise seat 14 from the lowered position to the raised position, the process is reversed. However, the configuration of the distal end 52 of seat 14 allows for safe reengagement of end portion 48 on lower horizontal member 32*a*. Specifically, end portion 48 has a lower beveled portion 54 and a rounded tip 56 adjacent recess 50. If in placing end portion 48 onto lower horizontal member 32*a*, lower horizontal member 32*a* hits beveled portion 54, the seat will fall to its lowered position immediately, rather than being suspended on lower horizontal member 32*a* outside of recess 50. In other words, with a rounded tip 56 and a beveled portion 54, when seat member 14 is being raised to its raised position, lower horizontal member 32*a* will either engage within recess 50 safely (to allow the user to sit down), or the seat will fall before the user can even begin using the seat. Thus, the user will know whether or not the seat is safely engaged.

To prevent seat 48 from swinging substantially while it is in the lowered position, a releasable fastener (e.g. a Velcro-type fastener, not shown) can be used on the under side of seat 14 to hold seat 14 against a lower structural member 58 (see FIG. 2). In that fashion, seat 14 can remain virtually flush against the inside of one of the sides of the walker allowing the user to stand between the two side frames of the walker. In addition, when the seat is lowered as shown in FIG. 2, the walker can be folded as shown in FIG. 3 virtually to the same degree as though the seat were not on the walker. In other words, the seat does not substantially interfere with the normal folding of the walker nor the compactness of the walker when folded.

Other advantages and features of the walker should be apparent. In addition, other embodiments should be apparent to one of ordinary skill in the art. All such embodiments are considered to be within the scope of this invention unless the claims that follow expressly state otherwise.

It is claimed:

1. A folding seat for an invalid walker, the walker having a pair of side frames, each of which has a horizontal support member, said folding seat comprising:

a first hanger member having an upper portion adapted to be secured to the one of the walker horizontal support members and having a horizontal seat support member spaced below said upper portion;

a substantially rigid seat having two ends with a slot at one end that captively receive said horizontal seat support of said first hanger member while allowing said seat to rotate on and to be moved a preselected distance orthogonal to said horizontal seat support member;

a second hanger member having an upper portion adapted to be secured to the other walker horizontal support member and having a horizontal seat support member adapted to support the other end of said seat below the other walker support member, and wherein said other end of said seat has an open recess on its underside adapted to releasably receive and rest upon said horizontal seat support member of said second hanger member.

2. The folding seat of claim 1 wherein said seat has a beveled section between said open recess and said other end of said seat, whereby if said seat is placed on said horizontal seat support member of said second hanger member outside of said open recess, said seat will drop from said second hanger member before a user can sit on said seat.

3. The folding seat of claim 1 wherein said horizontal seat support member of said first and second hanger members both have forward projecting portions that space said seat from a front of a walker when said folding seat is installed on a walker.

4. The folding seat of claim 3 wherein said forward projecting portions each include a clamp adapted to be secured to a front of a walker on which said folding seat is installed.

5. The folding seat of claim 1 wherein each of said first and second hanger members includes a pair of spaced vertical members with upper ends, and wherein said upper portions of said first and second hanger members comprises hooks formed on said upper ends adapted to suspend said hanger members from horizontal support members on a walker.

6. The folding seat of claim 5 wherein said hooks on said first hanger member are joined by a cross piece and said hooks on said second hanger member are Joined by a cross piece.

7. The folding seat of claim 1 wherein said seat is adapted to be pivoted on said first hanger member to a position substantially flush against one side frame of a walker when said seat is installed on a walker.

8. An invalid walker, comprising:

first and second side frames each having a front leg, a rear leg and a horizontal support member;

a front frame joining said side frames at a front of said walker;

a first hanger member having an upper portion secured to one of said walker horizontal support members and having a horizontal seat support member located below said one horizontal support member;

a substantially rigid seat having two ends with a slot at one end that captively receives said horizontal seat support member of said first hanger member while allowing said seat to rotate on and to be moved a preselected distance orthogonal to said horizontal seat support member;

a second hanger member having an upper portion secured to the other walker horizontal support member and a horizontal seat support member adapted to support the other end of said seat below said other horizontal support member, and wherein said other end of said seat has an open recess on its underside adapted to releasably receive and rest upon said horizontal seat support member of said second hanger member.

9. The invalid walker of claim 8 wherein said seat has a beveled section between said open recess and said other end of said seat, whereby if said seat is placed on said horizontal seat support member of said second hanger member outside of said open recess, said seat will drop from said second hanger member before a user can sit on said seat.

10. The invalid walker of claim 8 wherein said horizontal seat support members of said first and second hanger members both have forward projecting portions that space said seat from the front of said walker.

11. The invalid walker of claim 10 wherein said forward projecting portions each include a clamp secured to the front of said walker.

12. The invalid walker of claim 8 wherein each of said first and second hanger members includes a pair of spaced vertical members with upper ends, and wherein said upper portions of said first and second hanger members comprise hooks on said upper ends of said vertical members, said hooks on said first hanger member suspending said first hanger member from said one horizontal support member and said hooks on said second hanger member suspending said second hanger member from said other horizontal support member.

13. The invalid walker of claim 12 wherein said hooks on said first hanger member are joined by a cross piece and said hooks on said second hanger member are joined by a cross piece.

14. The invalid walker of claim 8 wherein said seat is adapted to be pivoted on said first hanger member to a position flush against said first side frame.

15. An invalid walker comprising:

first and second side frames each having a front leg, a rear leg and a support member connected between said front and rear leg;

a first horizontal seat support member connected to and spaced below said support member for said first side frame;

a second horizontal seat support member connected to and spaced below said support member for said second side frame; and a substantially rigid seat having a first end secured to rotate on said first horizontal seat support member between a generally horizontal position and a position substantially flush with said first side frame and having a second end adapted to be releasably attached to said second horizontal seat support member when said seat is in said generally horizontal position.

16. The invalid walker of claim 15, and wherein said second seat end is releasably attached to said second horizontal seat support member by an open recess located on an under side of said seat adjacent said second seat end to receive said second horizontal seat support member.

17. The invalid walker of claim 16, wherein said seat is secured to said first horizontal seat support member to be moved a preselected distance orthogonal to said first horizontal seat support member to facilitate positioning said open recess on said seat on said second horizontal seat support member.

18. The invalid walker of claim 17 and wherein said seat has a beveled section between said open recess and said second seat end, whereby if said seat is placed on said second horizontal seat support member between said open recess and said second seat end, said seat will drop from said second horizontal seat support member before a user can sit on said seat.

* * * * *